US009380898B2

(12) United States Patent
Mason

(10) Patent No.: US 9,380,898 B2
(45) Date of Patent: Jul. 5, 2016

(54) LID HAVING COLLAPSIBLE STRAW FOR BOTTLE

(71) Applicant: Cool Gear International, LLC, Plymouth, MA (US)

(72) Inventor: John D. Mason, Brockton, MA (US)

(73) Assignee: Cool Gear International, LLC, Plymouth, MA (US)

( * ) Notice: Subject to any disclaimer, the term of this patent is extended or adjusted under 35 U.S.C. 154(b) by 21 days.

(21) Appl. No.: 14/137,505

(22) Filed: Dec. 20, 2013

(65) Prior Publication Data

US 2015/0173539 A1 Jun. 25, 2015

(51) Int. Cl.

| | |
|---|---|
| ***A47G 19/22*** | (2006.01) |
| ***B65D 77/28*** | (2006.01) |
| ***B65D 47/06*** | (2006.01) |
| ***B65D 47/08*** | (2006.01) |

(52) U.S. Cl.

CPC ..... *A47G 19/2272* (2013.01); *B65D 47/063* (2013.01); *B65D 47/066* (2013.01); *B65D 47/08* (2013.01); *B65D 77/283* (2013.01)

(58) Field of Classification Search

CPC ..... A47G 19/2266; A47G 19/2272; B65D 43/26; B65D 47/061; B65D 47/066; B65D 47/0871; B65D 47/2037; B65D 51/165; B65D 77/28; B65D 77/283; B65D 2251/1058; B65D 2251/1066

USPC ..... 215/228–229, 387–388; 220/252, 220/254.1, 254.3, 259.1, 703, 705, 709, 220/DIG. 7; 222/464.1, 464.3, 499, 513, 222/522, 527

See application file for complete search history.

(56) References Cited

U.S. PATENT DOCUMENTS

| | | | | | |
|---|---|---|---|---|---|
| 4,925,040 | A * | 5/1990 | Wang | A45F 3/16 | 215/388 |
| 5,203,468 | A * | 4/1993 | Hsu | 220/254.3 | |
| 5,282,541 | A * | 2/1994 | Chen | 215/229 | |
| 5,346,081 | A * | 9/1994 | Lin | B65D 47/066 | 215/229 |
| 5,465,866 | A * | 11/1995 | Belcastro | 220/709 | |
| 6,116,458 | A * | 9/2000 | Dark | A47G 19/2266 | 220/708 |
| 6,276,560 | B1 * | 8/2001 | Belcastro | 220/709 | |
| 6,279,773 | B1 * | 8/2001 | Kiyota | 220/709 | |
| 7,093,735 | B2 * | 8/2006 | Stephens | 220/705 | |
| 7,533,783 | B2 * | 5/2009 | Choi | B65D 47/065 | 220/705 |
| 8,550,269 | B2 * | 10/2013 | Lane | 215/229 | |
| 8,602,238 | B2 * | 12/2013 | El-Saden et al. | 215/389 | |
| 2002/0040909 | A1 * | 4/2002 | Goto et al. | 220/709 | |
| 2002/0170874 | A1 * | 11/2002 | Hou | 215/229 | |
| 2004/0069783 | A1 * | 4/2004 | Chen | 220/254.3 | |
| 2012/0048858 | A1 * | 3/2012 | Peters et al. | 220/264 | |
| 2013/0220966 | A1 * | 8/2013 | Lane | 215/228 | |
| 2014/0061248 | A1 * | 3/2014 | Hoskins | B65B 3/00 | 222/212 |

* cited by examiner

*Primary Examiner* — J. Gregory Pickett
*Assistant Examiner* — Brijesh V. Patel
(74) *Attorney, Agent, or Firm* — Mintz Levin Cohn Ferris Glovsky and Popeo, P.C.; Steven M. Jensen

(57) ABSTRACT

A lid connected to a container or body portion of a bottle includes: a base defining a channel; a cover in communication with a top of the channel; a lid-latch configured to releasably engage the cover and hold the cover proximate the top of the channel; and a tube defining a conduit housed in the channel and coupled to the base. At least a portion of the tube is resiliently collapsible so as to bias the cover away from the top of the channel.

22 Claims, 6 Drawing Sheets

LID HAVING COLLAPSIBLE STRAW FOR BOTTLE

BACKGROUND

Some conventional drink bottles or containers that house water or other potable beverages can include a lid. Some lids may include a spout, a nozzle or an opening to fit, for example, a tube or straw, and allow a user to access or drink the liquids contained within the bottle without removing the lid. However, such spouts, nozzles and/or openings are susceptible to leaks, particularly as the bottle is jostled during every day travels.

Accordingly, there is a need for improved lids for bottles that possess leak resistance while allowing access contents of the bottle without removing the lid.

SUMMARY

One aspect of the disclosure provides a lid having a base that defines a channel and a cover or cap in communication with a top of the channel. The lid includes a lid-latch configured to releasably engage the cover and hold the cover proximate the top of the channel in the closed position. The lid also includes a tube that defines a conduit. The tube is housed in the channel of the lid and coupled to its base. The tube permits access to contents (e.g., liquids) of a corresponding container via the conduit. At least a portion of the tube is collapsible so as to bias the cover away from the top of the channel. In addition, the tube, when collapsed, restricts fluid flow through the conduit.

In certain embodiments, the lid further includes a nipple coupled to the tube. The nipple is configured to restrictively allow fluid flow through the conduit. According to some embodiments, the nipple is coupled to a proximal end of the tube. Operatively, the nipple, when moved toward a distal end of the tube (e.g., when the tube is compressed), causes a middle portion of the tube is resiliently collapsed thereby restricting fluid flow through the conduit, as discussed above.

In other embodiments, the channel of the lid (which houses the tube) also defines a path of movement for the nipple.

In some embodiments, the lid further includes a hinge attaching the cover to the lid. In such embodiments, the cover is biased away from the top of the channel via the hinge (e.g., in addition to the compressed tube). The hinge is typically formed, at least in part, from silicone.

According to other embodiments, the cover includes a cover-latch that engages the lid-latch of the lid. Operationally, the cover pivots about the hinge into open and closed positions. In the closed position, the cover-latch engages the lid-latch thereby holding the cover proximate the top of the channel. To open the lid, the lid-latch is disengaged (e.g., via a release member) thereby allowing the cover to pivot open or away from the top of the channel (e.g., via a bias from the compressed tube and/or a bias from the cover hinge, discussed above). The release member is actuated toward the tube to cause the lid-latch to release the cover.

In certain other embodiments, the lid further includes a nipple coupled to the tube. The nipple is configured to restrictively allow fluid flow through the conduit. Similarly, the tube, when compressed, also restricts fluid flow through the conduit.

Notably, as discussed herein, the lid is configured to couple to a drink container, e.g., a bottle. The above discussed embodiments can be implemented alone or in combination, as is understood by those skilled in the art.

These and other features of the lid of the subject disclosure will become more readily apparent to those skilled in the art from the following detailed description of the various embodiments taken in conjunction with the drawings.

BRIEF DESCRIPTION OF THE DRAWINGS

For a fuller understanding of the nature and desired objects of the present invention, reference is made to the following detailed description taken in conjunction with the figure wherein.

DEFINITIONS

The instant invention is most clearly understood with reference to the following definitions:

As used in the specification and claims, the singular form "a," "an," and "the" include plural references unless the context clearly dictates otherwise.

As used in the specification and claims, the terms "comprises," "comprising," "containing," "having," and the like can have the meaning ascribed to them in U.S. patent law and can mean "includes," "including," and the like.

Unless specifically stated or obvious from context, as used herein, the term "or" is understood to be inclusive.

DETAILED DESCRIPTION OF THE INVENTION

Figure 1:
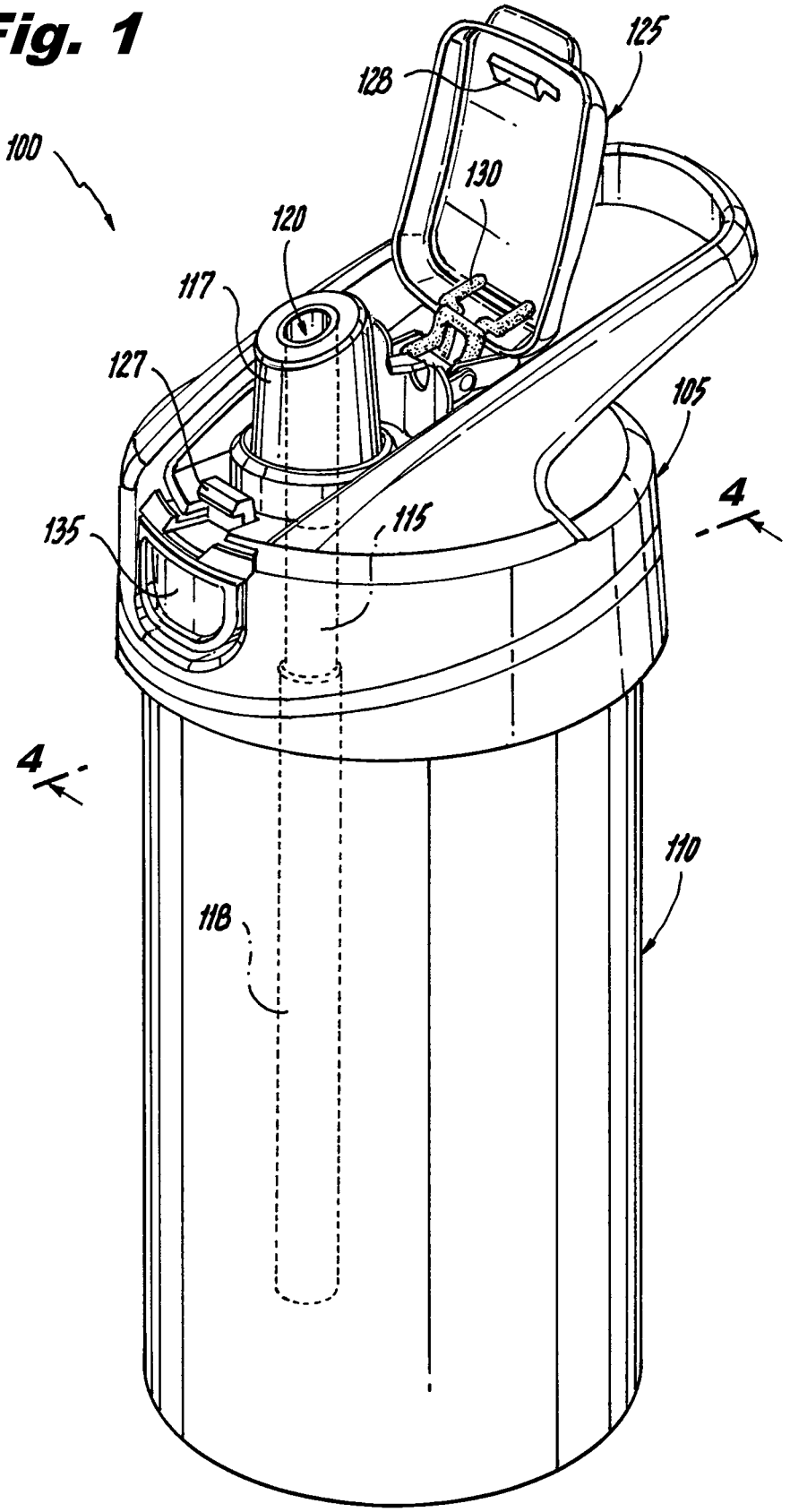
FIG. 1 is a perspective view of a lid arranged on a bottle according to one representative embodiment of the present invention, showing the lid in an open position.

Various aspects of the invention provide lids and containers. Reference will now be made to the drawings wherein like reference numerals identify similar structural features or aspects of the subject invention. For purposes of explanation and illustration, and not limitation, a perspective view of an exemplary embodiment of a lid in accordance with the disclosure is shown in FIG. 1 and is designated generally by reference character 100. Other aspects of the lid are provided in FIGS. 2-6, as will be described herein. The lids of this disclosure can be used in with various containers, bottles, canisters, or other suitable applications.

As shown in FIG. 1, a lid 100 can include a base portion 105, which can be coupled to a container or body portion 110, and together can be referred to as a "bottle." Container 110 can be sized to hold a volume of liquid and can include a neck portion having an opening that can releasably couple to base portion 105. For example, the neck portion and base portion 105 can be coupled by complimentary threading (e.g., a screw on configuration), a snap closure, etc. Lid 100 can also include a spout or tube 115 defining a conduit 120 therein, where the spout or tube defines a straw. As shown, tube 115 can be coupled to an extension portion 118 so as to access liquid housed within container 110 (e.g., a person can draw liquid up through extension tube 118 through conduit 120 of tube 115). In other embodiments, tube 115 can be formed integral (e.g., via a single mold) with the extension tube 118. Alternatively, extension tube 118 may not be present, thus requiring a user to tilt and pour liquid out of container 110 via tube 115. Additionally, as shown, tube 115 can be formed or coupled with a nipple 117 (e.g., a one way valve, a bite valve, etc.).

Figure 2:
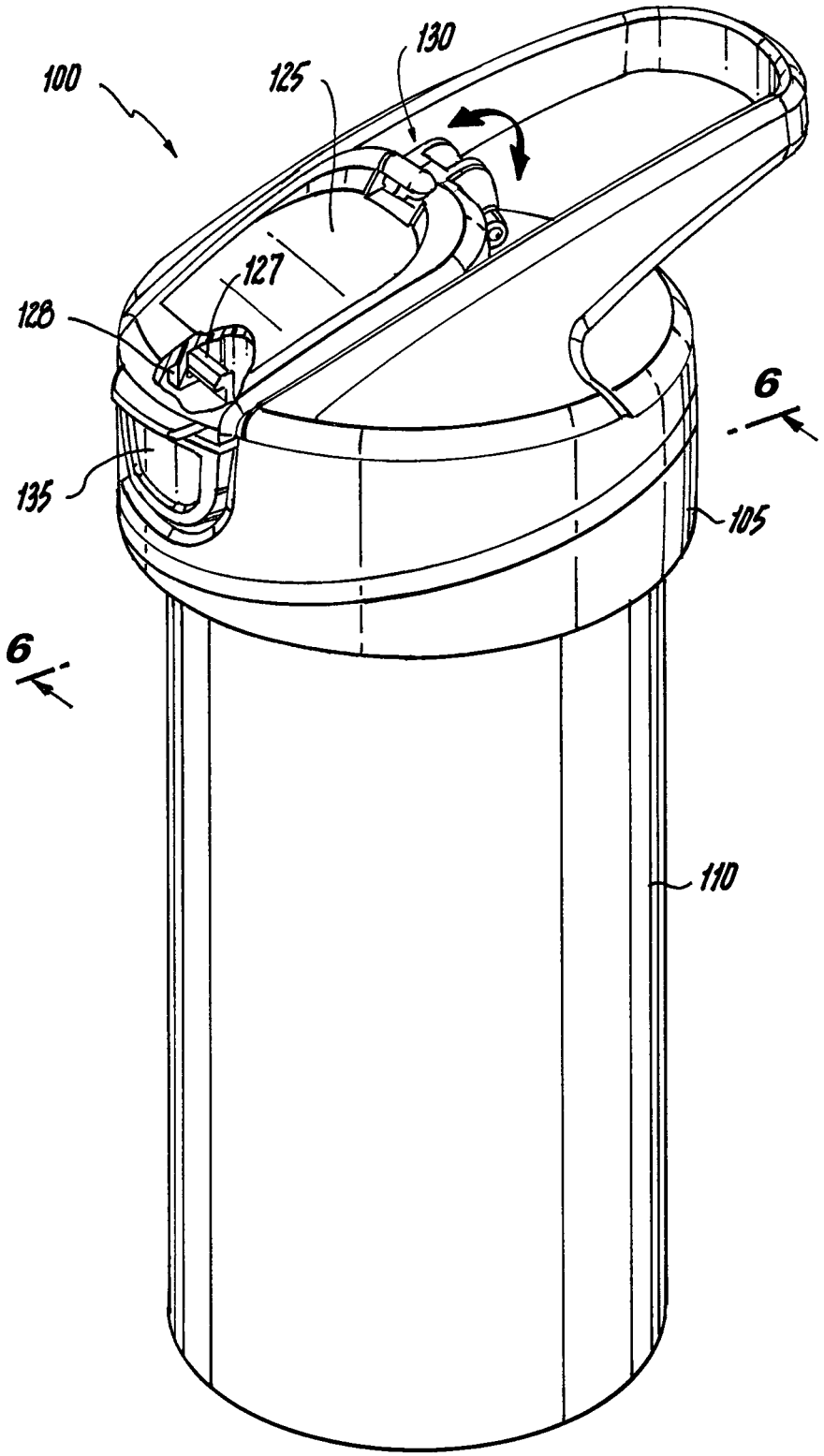
FIG. 2 is a perspective view of the lid arranged on the bottle of FIG. 1, showing the lid in a closed position.

Still referring to FIG. 1, lid 100 includes a cover 125 that pivots about a hinge 130 to open and close the lid. Lid 100 also includes a lid-latch 127 that releasably mates or releasably engages with a corresponding cover-latch 128. In operation, lid-latch 127 holds cover 125 proximate to tube 115 causing lid 100 to maintain a closed position as depicted in FIG. 2. Lid-latch 127 disengages cover-latch 128 via actuating a release member 135 toward tube 115. As shown, lid-latch 127 is formed integral with release member 135. Release member 135 (and thus, lid-latch 127) is biased away from tube 115 via a spring. In this fashion, lid-latch 127 catches or engages with cover-latch 128 and hold cover-latch 128 proximate a top of tube 115 when cover 125 is closed.

Referring now to FIG. 2, a perspective view of lid 100 is shown in a closed position. Operatively, as discussed above, cover 125 pivots about hinge 130 into a closed position, which causes tube 115 to resiliently collapse about itself. In the closed position, conduit 120 (not shown) is restricted (e.g., the walls of tube 115 collapse or fold on each other). In other words, tube 115 can include a flexible material such as silicone that folds over itself thereby restricting or compressing the inner walls of tube 115 to prevent liquid from escaping container 110, when tube 115 is collapsed. In some embodiments, tube 115 is biased against collapse such that tube 115 pushes against or resists cover 125 as cover 125 rotates into the closed position. Further, as shown, lid-latch 127 is engaged or mated with corresponding cover-latch 128 thereby holding cover 125 in the closed position.

Figure 3:
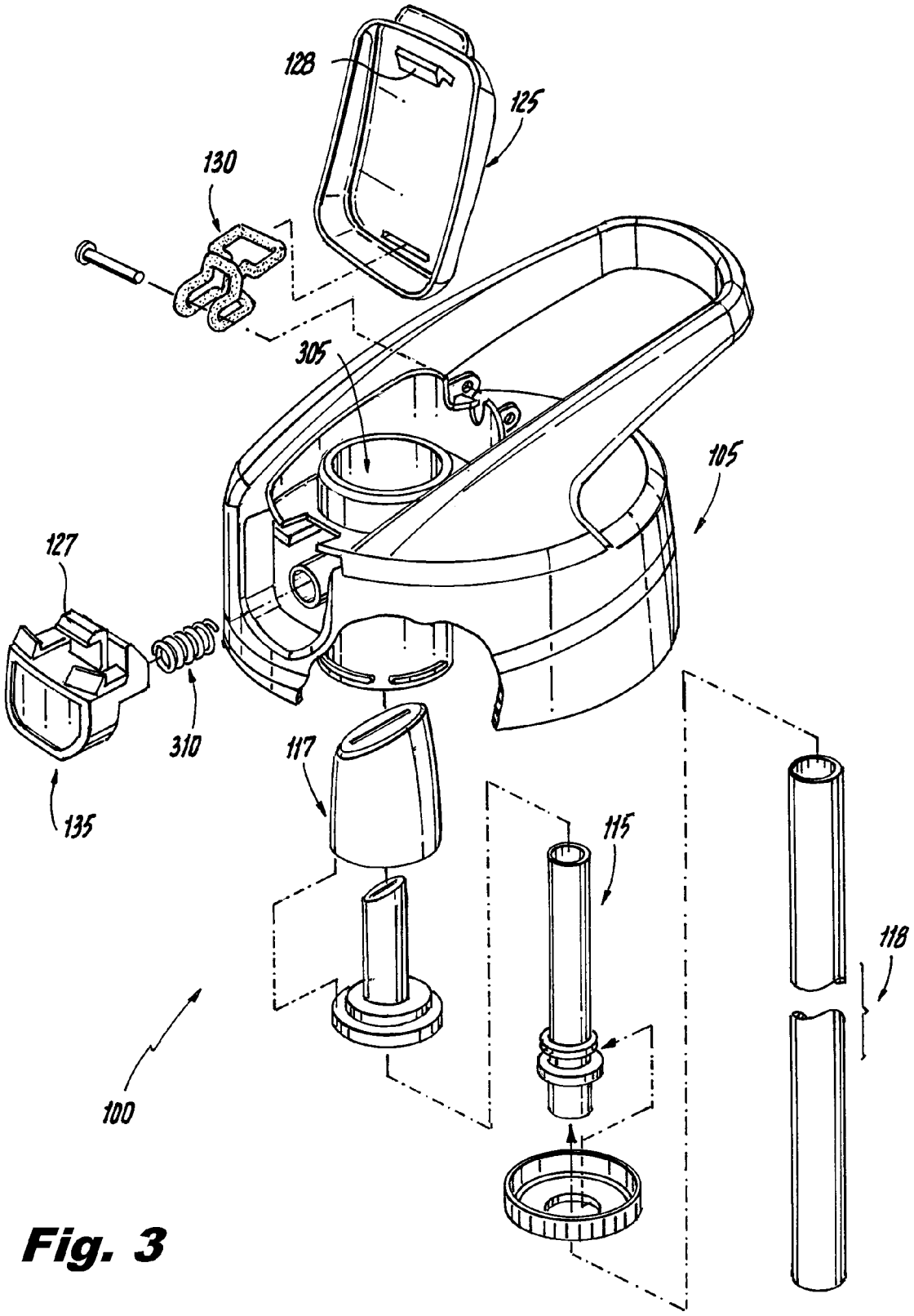
FIG. 3 is an exploded perspective view of the lid shown in FIG. 1.

With reference now to FIG. 3, components of lid 100 are shown in an exploded perspective view. Notably, each of these components can be individually constructed (e.g., via known molding techniques), constructed in various combinations, or constructed as a one piece design (e.g., via 3-D printing or other similar molding techniques).

As shown, lid 100 includes a channel 305, which receives tube 115 and nipple 117. Channel 305 is configured to provide a path of movement for nipple 117 (and tube 115). Notably, in some embodiments, channel 305 and/or nipple 117 are configured to prevent tube 115 and nipple 117 from being removed from lid 100. For example, nipple 117 can be fixed to tube 115 and tube 115 can be configured to attach to a bottom of channel 305 thereby preventing tube 115 and nipple 117 from being removed from channel 305. Further, channel 305 can include a tapered design whereby the channel becomes narrow at the opening that nipple 117 exits. Similarly, nipple 117 can include a complimentary tapered design whereby nipple 117 is thicker at a base portion so as to prevent nipple 117 from being pulled through a top of channel 305. Additional configurations are also appreciated without departing from the spirit and scope of the present invention (e.g., protrusions and complimentary receiving orifices, etc.).

FIG. 3 also illustrates a spring 310 that biases release member 135 away from tube 115 and channel 305. As discussed above, cover 125 pivots about hinge 130 to open and close the lid while release member 135 acts to releasably engage/disengage lid-latch 127 to/from cover-latch 128. In particular, when release member 135 is actuated toward tube 115 thereby compressing spring 310, lid-latch 127 disengages cover-latch 128.

Figure 4:
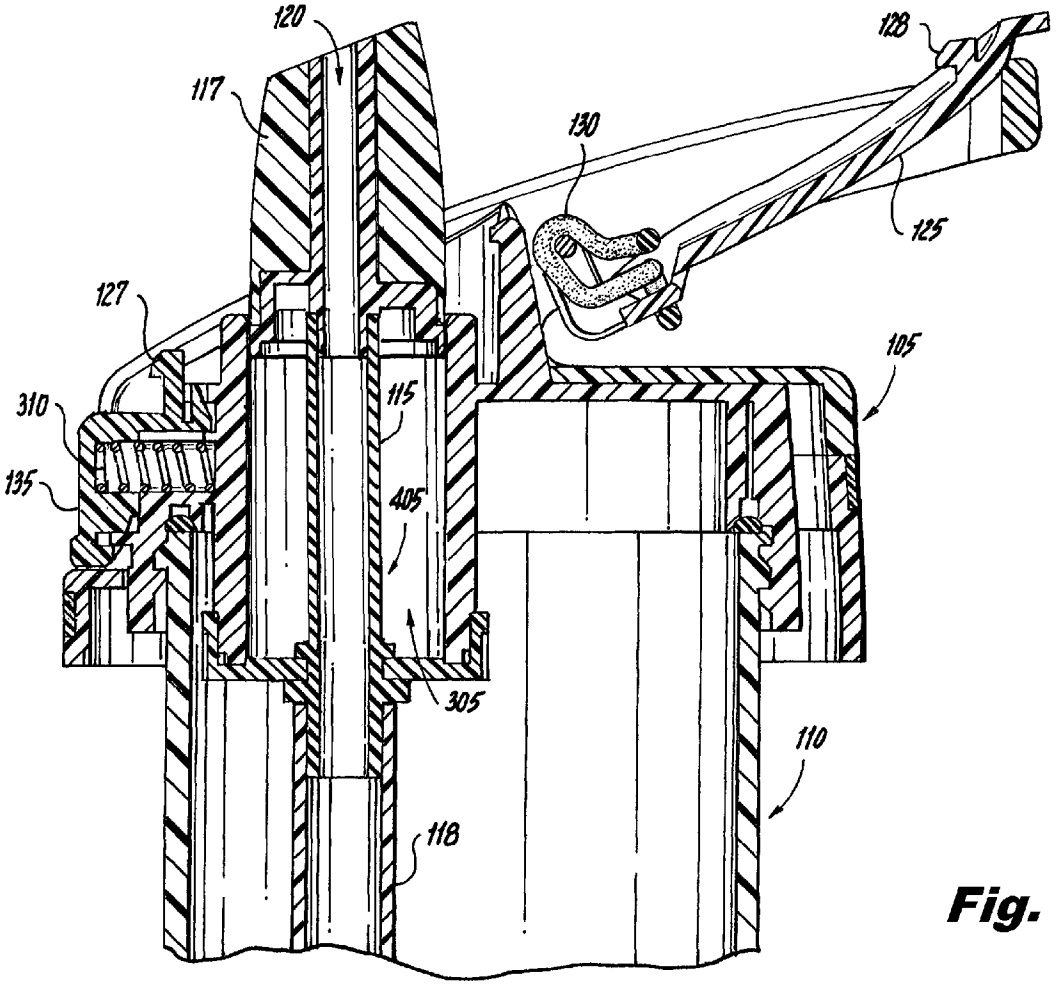
FIG. 4 is a cross-sectional side elevation view of the lid taken at cut lines 4-4 of FIG. 1.
Figure 5:
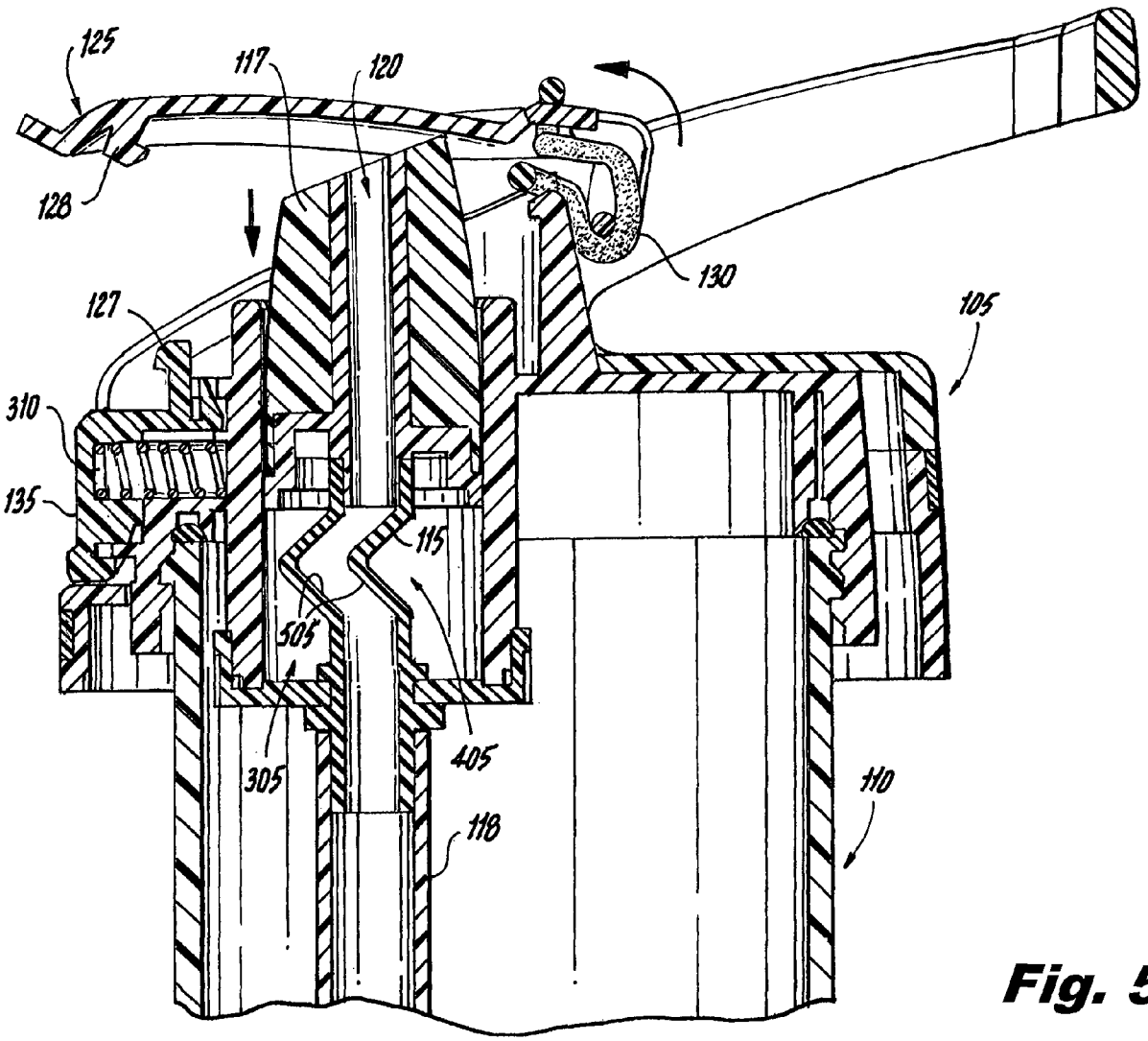
FIG. 5 is a cross-sectional side elevation view of the lid shown in FIG. 1, showing the lid between the open and the closed position.
Figure 6:
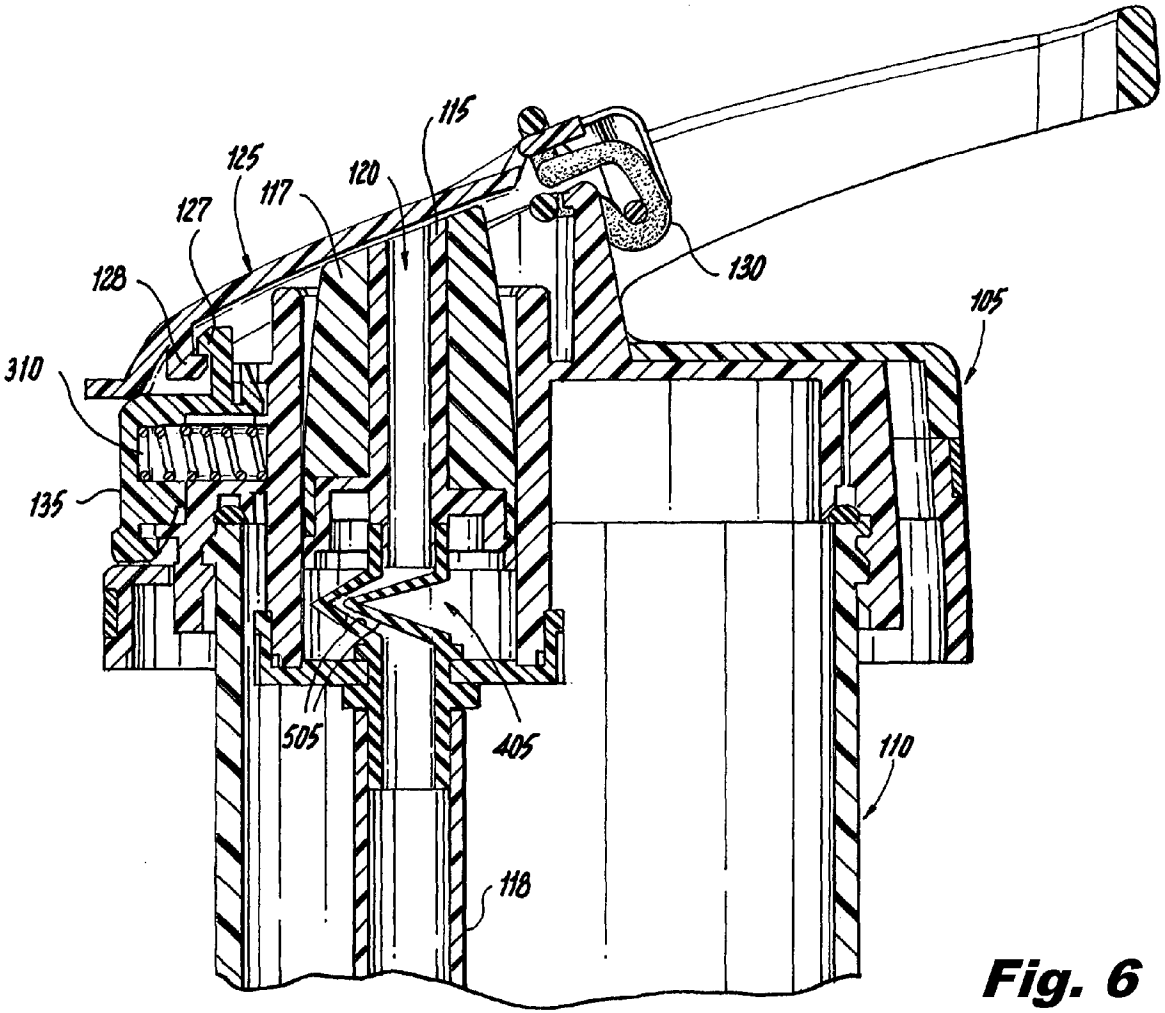
FIG. 6 is a cross-sectional side elevation view of the lid taken at cut lines 6-6 of FIG. 2.

FIGS. 4-6 provide cross-sectional side elevation views of lid 100 when operated to open and close tube 115. Particularly, FIG. 4 is a cross-sectional side elevation view taken at cut lines 4-4 of FIG. 1 and showing tube 115 in the open position. As shown, cover 125 pivots about hinge 130 to begin closing the lid 100. Notably, FIG. 4 illustrates tube 115 in an open position with a middle portion 405 fully extended.

FIG. 5 is a cross-sectional side elevation view of the lid 100, showing cover 125 approaching tube 115 (and nipple 117). Nipple 117 actuates or moves in a path defined by channel 305 (i.e., perpendicularly upward and downward relative to lid 100). When cover 125 approaches tube 115, nipple 115 actuates or moves down channel 305 thereby causing tube 115 to begin to collapse about middle portion 405. That is, middle portion 405 of tube 115 begins to fold or collapse on itself when nipple 117 traverses down channel 305. When middle portion 405 collapses, inner walls 505 begin compress thereby restricting restrict conduit 120.

FIG. 6 is a cross-sectional side elevation view of the lid 100 taken at cut lines 6-6 of FIG. 2, showing tube 115 in the closed position with lid-latch 127 releasably engaging cover 125 (via cover latch 128) and holding cover 125 proximate the top of channel 305. As shown, nipple 117 is retained within channel 305 via cover 125 thereby causing tube 115 to collapse about middle portion 405. When tube 115 is collapsed, inner walls 505 compress to restrict fluid flow through conduit 120 thereby preventing liquids from escaping lid 100. The progression shown in FIGS. 4-6 can be reversed to open lid 100 as discussed above. Upon opening lid 100, cover 125 rotates about hinge 130, nipple 117 traverses channel 305 to exit conduit 120 and middle portion 405 of tube 115 extends.

The embodiments described herein and shown in the drawings, provide for a lid that can be opened and closed without removal of the lid. In particular, a user can easily move the tube 115 between an open and a closed position via the actuating release member 135 and consume a liquid (e.g., a beverage) in the container. While these embodiments have been described using specific terms, such description is for illustrative purposes only, and it is to be understood that changes and variations may be made without departing from the spirit or scope of the following claims.

The invention claimed is:

1. A lid comprising:

a base defining a channel;

a cover in communication with a top of the channel;

a lid-latch configured to releasably engage the cover and hold the cover proximate the top of the channel;

a tube defining a conduit housed in the channel and coupled to the base, at least a portion of the tube being resiliently collapsible so as to bias the cover away from the top of the channel; and a nipple coupled to the tube, the nipple configured to restrictively allow fluid flow through the conduit, wherein when the cover is moved from an open position to a closed position in which the cover engages the lid-latch, the nipple moves in a perpendicular direction relative to the lid, thereby collapsing inner walls of the tube to prevent fluid flow.

2. The lid of claim 1, wherein the tube, when collapsed, restricts fluid flow through the conduit.

3. The lid of claim 1, wherein when the cover is moved from the open position to the closed position, the cover engages the nipple so as to push the nipple in the perpendicular direction.

4. The lid of claim 1, wherein the nipple is coupled to a proximal end of the tube, and the nipple, when moved toward a distal end of the tube, causes a middle portion of the tube to resiliently collapse.

5. The lid of claim 4, wherein the channel defines a path of movement for the nipple.

6. The lid of claim 1, further comprising:

a hinge attaching the cover to the lid.

7. The lid of claim 6, wherein the cover is further biased away from the top of the channel via the hinge.

8. The lid of claim 7, wherein the hinge is formed at least in part from silicone.

9. The lid of claim 1, wherein the cover includes a cover-latch that engages the lid-latch.

10. The lid of claim 9, wherein the lid-latch disengages the cover when a release member is actuated toward the tube.

11. The lid of claim 1, wherein the base is configured to releasably couple to a drink container.

12. A bottle comprising:

a lid comprising:

a base defining a channel;

a cover in communication with a top of the channel;

a lid-latch configured to releasably engage the cover and hold the cover proximate the top of the channel;

a tube defining a conduit housed in the channel and coupled to the base, at least a portion of the tube being resiliently collapsible so as to bias the cover away from the top of the channel; and a nipple coupled to the tube, the nipple configured to restrictively allow fluid flow through the conduit, wherein when the cover is moved from an open position to a closed position in which the cover engages the lid-latch, the nipple moves in a perpendicular direction relative to the lid, thereby collapsing inner walls of the tube to prevent fluid flow; and a body portion coupled to the base, the body portion configured to hold a volume of liquid.

13. The bottle of claim 12, wherein the tube, when collapsed, restricts fluid flow through the conduit.

14. The bottle of claim 12, wherein when the cover is moved from the open position to the closed position, the cover engages the nipple so as to push the nipple in the perpendicular direction.

15. The bottle of claim 12, wherein the nipple is coupled to a proximal end of the tube, wherein the nipple, when moved toward a distal end of the tube causes a middle portion of the tube to resiliently collapse.

16. The bottle of claim 15, wherein the channel defines a path of movement for the nipple.

17. The bottle of claim 16, further comprising:

a hinge attaching the cover to the lid.

18. The bottle of claim 17, wherein the cover is further biased away from the top of the channel via the hinge.

19. The bottle of claim 18, wherein the cover includes a cover-latch that engages the lid-latch.

20. The bottle of claim 19, wherein the lid-latch disengages the cover when a release member is actuated toward the tube.

21. A lid comprising:

a base defining a channel;

a cover in communication with a top of the channel;

a lid-latch configured to releasably engage the cover and hold the cover proximate the top of the channel;

a tube defining a conduit housed in the channel and coupled to the base, the tube being arranged so as to bias the cover away from the top of the channel; and a nipple coupled to the tube, the nipple configured to restrictively allow fluid flow through the conduit, wherein when the cover is moved from an open position to a closed position in which the cover engages the lid-latch, the nipple moves in a perpendicular direction relative to the lid, and the nipple is coupled to a proximal end of the tube, and the nipple, when moved toward a distal end of the tube, causes a middle portion of the tube to resiliently collapse so as to prevent fluid flow.

22. The lid of claim 21, wherein when the cover is moved from the open position to the closed position, the cover engages the nipple so as to push the nipple in the perpendicular direction.

* * * * *